US011667507B2

(12) United States Patent
Mullenaux

(10) Patent No.: US 11,667,507 B2
(45) Date of Patent: Jun. 6, 2023

(54) BOTTLE-FILLING SYSTEM

(71) Applicant: AQUAPHANT, INC., Las Vegas, NV (US)

(72) Inventor: Thomas Mullenaux, San Pedro, CA (US)

( * ) Notice: Subject to any disclaimer, the term of this patent is extended or adjusted under 35 U.S.C. 154(b) by 95 days.

(21) Appl. No.: 17/361,635

(22) Filed: Jun. 29, 2021

(65) Prior Publication Data

US 2022/0259028 A1 Aug. 18, 2022

Related U.S. Application Data

(63) Continuation-in-part of application No. 17/176,350, filed on Feb. 16, 2021.

(51) Int. Cl.

| | |
|---|---|
| ***B67C 3/26*** | (2006.01) |
| ***B67D 1/00*** | (2006.01) |
| ***B67C 3/00*** | (2006.01) |
| ***A47G 19/22*** | (2006.01) |
| ***B67C 3/24*** | (2006.01) |
| ***B67C 3/20*** | (2006.01) |
| ***B67D 1/12*** | (2006.01) |
| ***B67D 1/08*** | (2006.01) |

(52) U.S. Cl.

CPC ..... *B67D 1/0008* (2013.01); *A47G 19/2205* (2013.01); *B67C 3/007* (2013.01); *B67C 3/20* (2013.01); *B67C 3/24* (2013.01); *B67C 3/2631* (2013.01); *B67D 1/0888* (2013.01); *B67D 1/0894* (2013.01); *B67D 1/124* (2013.01)

(58) Field of Classification Search

CPC .. B67D 1/0008; B67D 1/0888; B67D 1/0894; B67D 1/124; B67C 3/007; B67C 3/20; B67C 3/24; B67C 3/2361; A47G 19/2205

See application file for complete search history.

(56) References Cited

U.S. PATENT DOCUMENTS

| | | | | |
|---|---|---|---|---|
| 3,745,596 | A * | 7/1973 | Copeland | A47C 17/86 5/308 |
| 5,090,075 | A * | 2/1992 | Larson | A47C 27/085 5/672 |
| D342,393 | S * | 12/1993 | Cephas | D6/718 |
| 5,271,837 | A * | 12/1993 | Discepolo | B01J 47/024 210/453 |
| 6,513,343 | B2 * | 2/2003 | Pahl | B65D 81/3881 62/457.2 |
| 7,766,057 | B2 * | 8/2010 | Windmiller | B67D 1/0081 141/2 |
| 8,763,655 | B2 * | 7/2014 | Springer | B65D 1/06 141/2 |

(Continued)

*Primary Examiner* — Nicolas A Arnett

(74) *Attorney, Agent, or Firm* — Kyle A. Fletcher, Esq.

(57) ABSTRACT

The bottle filling system incorporates a bottle, a fill base structure, and a control structure. The bottle, the fill base structure, and the control structure are fluidically interconnected. The fill base structure and the control structure are electrically interconnected. The control structure controls the flow of a fluid from a pressurized fluid source into the fill base structure. The fill base structure transports the fluid received from the control structure to the bottle. The control structure detects the presence of the bottle relative to the fill base structure. The control structure measures the amount of fluid in the bottle. The control structure automatically replenishes the amount of fluid contained in the bottle.

15 Claims, 5 Drawing Sheets

(56) References Cited

U.S. PATENT DOCUMENTS

| | | | | |
|---|---|---|---|---|
| 8,777,182 | B2 * | 7/2014 | Springer | A47G 19/2205 137/499 |
| 8,899,281 | B2 * | 12/2014 | Russell | B67D 1/04 141/113 |
| 9,016,333 | B2 * | 4/2015 | Shaffer | B67D 1/1272 141/113 |
| 9,284,174 | B2 * | 3/2016 | Springer | B65D 1/06 |
| 10,759,644 | B2 * | 9/2020 | Lim | B67C 3/026 |
| 10,994,978 | B1 * | 5/2021 | Mullenaux | B60N 3/18 |
| 11,371,224 | B2 * | 6/2022 | Mullenaux | A47C 21/00 |
| 11,427,458 | B2 * | 8/2022 | Mullenaux | B67D 1/0007 |
| 2008/0223478 | A1 * | 9/2008 | Hantsoo | B67D 1/0894 141/2 |
| 2011/0240170 | A1 * | 10/2011 | Fallon | B67D 1/1272 220/601 |
| 2012/0103926 | A1 * | 5/2012 | Ibsies | B65D 1/06 141/113 |
| 2014/0182744 | A1 * | 7/2014 | Shaffer | B67D 1/0894 222/181.1 |
| 2016/0231029 | A1 * | 8/2016 | Pan | A47B 23/04 |
| 2017/0001853 | A1 * | 1/2017 | Park | B67D 1/1272 |
| 2018/0370784 | A1 * | 12/2018 | Bolender | B67D 1/1272 |
| 2021/0039942 | A1 * | 2/2021 | Springer | G06K 7/10415 |

* cited by examiner

BOTTLE-FILLING SYSTEM

CROSS REFERENCES TO RELATED APPLICATIONS

This non-provisional application claims priority under 35 USC 120 to U.S. non-provisional application Ser. No. 17/176,350 filed on Feb. 16, 2021 by the inventor: Thomas Mullenaux. This non-provisional application claims U.S. non-provisional application Ser. No. 17/176,350 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of table service including drinking vessels. (A47G19/22)

Background

This non-provisional application claims priority under 35 USC 120 to U.S. non-provisional application Ser. No. 17/176,350 filed on Feb. 16, 2021 by the inventor: Thomas Mullenaux. This non-provisional application claims U.S. non-provisional application Ser. No. 17/176,350 in its entirety.

The present disclosure will only reference the elements of the non-provisional application U.S. Ser. No. 17/176,350 that are relevant to the innovations disclosed within this application. This is done for purposes of simplicity and clarity of exposition. The applicant notes that this disclosure incorporates non-provisional application U.S. Ser. No. 17/176,350 in its entirety into this application. The fact that any specific innovation selected from the one or more innovations disclosed within U.S. Ser. No. 17/176,350 is not addressed in this application should not be interpreted as an indication of defect in the above referenced patent.

Within this disclosure, the non-provisional application U.S. Ser. No. 17/176,350 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure is a fluid containment structure. The prior disclosure is an automatic structure. By automatic is meant that, after the prior disclosure forms a fluidic connection with a pressurized fluid source the prior disclosure: a) opens a fluidic connection with the pressurized fluid source; and, b) receives fluid from the pressurized fluid source until a previously determined volume of fluid is contained in the prior disclosure. The prior disclosure comprises a bottle, a bottle fitting structure, a base plate, and a fluid control structure. The base plate forms a fluidic connection between the bottle fitting structure and the pressurized fluid source. The bottle fitting structure forms a fluidic connection between the bottle and the base plate. The fluid control structure automatically controls the flow of fluid from the pressurized fluid source through the base plate and the bottle fitting structure into the bottle.

SUMMARY OF INVENTION

The bottle filling system comprises a bottle, a fill base structure, and a control structure. The bottle, the fill base structure, and the control structure are fluidically interconnected. The fill base structure and the control structure are electrically interconnected. The control structure controls the flow of a fluid from a pressurized fluid source into the fill base structure. The fill base structure transports the fluid received from the control structure to the bottle. The control structure detects the presence of the bottle relative to the fill base structure. The control structure measures the amount of fluid in the bottle. The control structure automatically replenishes the amount of fluid contained in the bottle.

These together with additional objects, features and advantages of the bottle filling system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bottle filling system in detail, it is to be understood that the bottle filling system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bottle filling system.

It is therefore important that the claims be regarded as including such equivalent construction insofar as they do not depart from the spirit and scope of the bottle filling system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

This non-provisional application claims priority under 35 USC 120 to U.S. non-provisional application Ser. No. 17/176,350 filed on Feb. 16, 2021 by the inventor: Thomas Mullenaux. This non-provisional application claims U.S. non-provisional application Ser. No. 17/176,350 in its entirety.

Figure 1:
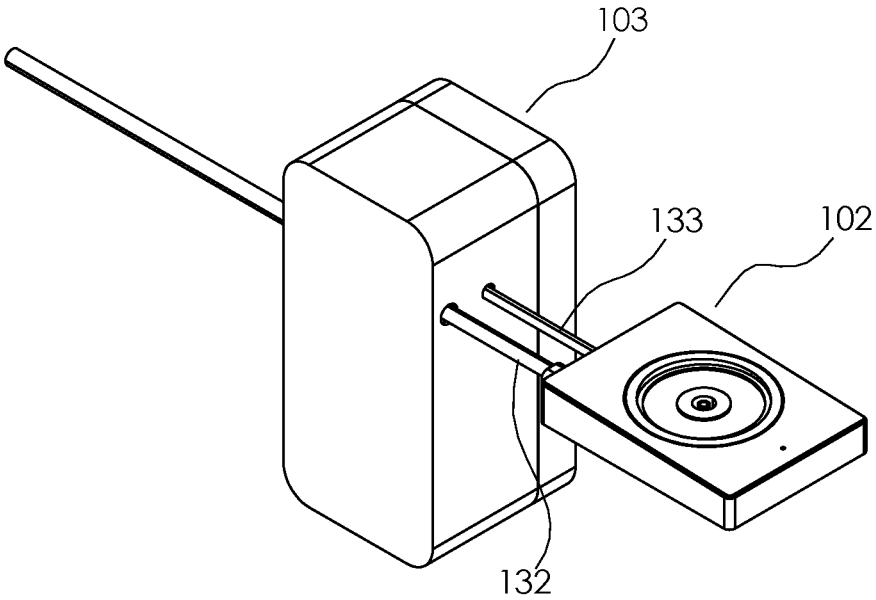
FIG. 1 is a perspective view of an embodiment of the disclosure.
Figure 2:
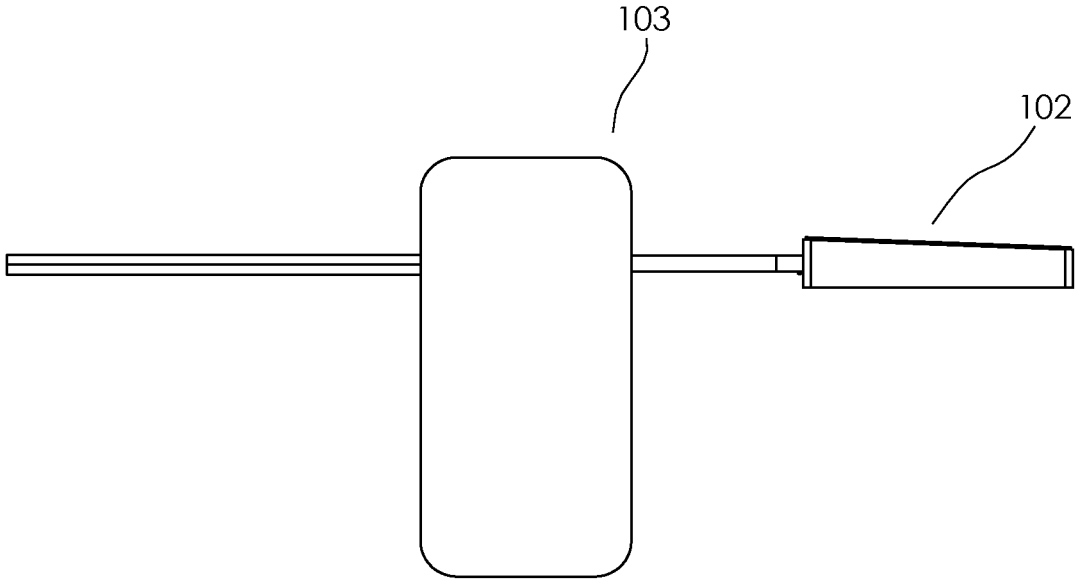
FIG. 2 is a front view of an embodiment of the disclosure.
Figure 3:
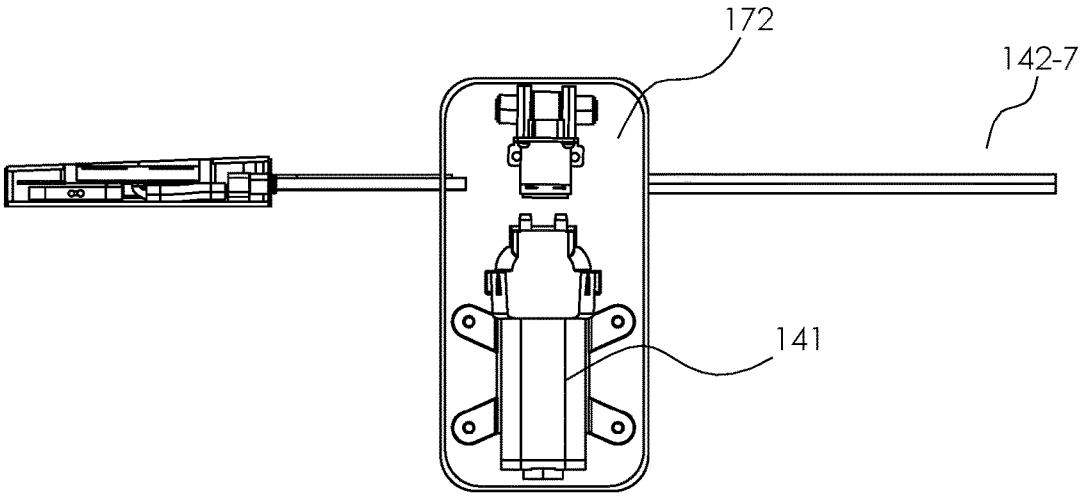
FIG. 3 is a cross-sectional view of an embodiment of the disclosure.
Figure 4:
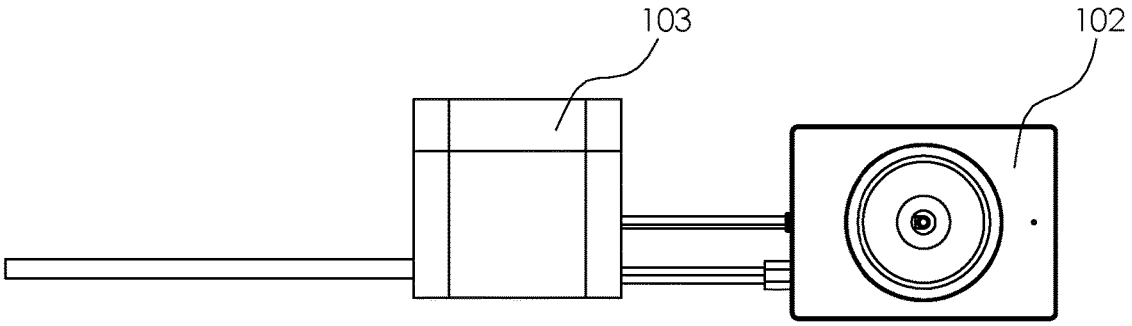
FIG. 4 is a top view of an embodiment of the disclosure.
Figure 5:
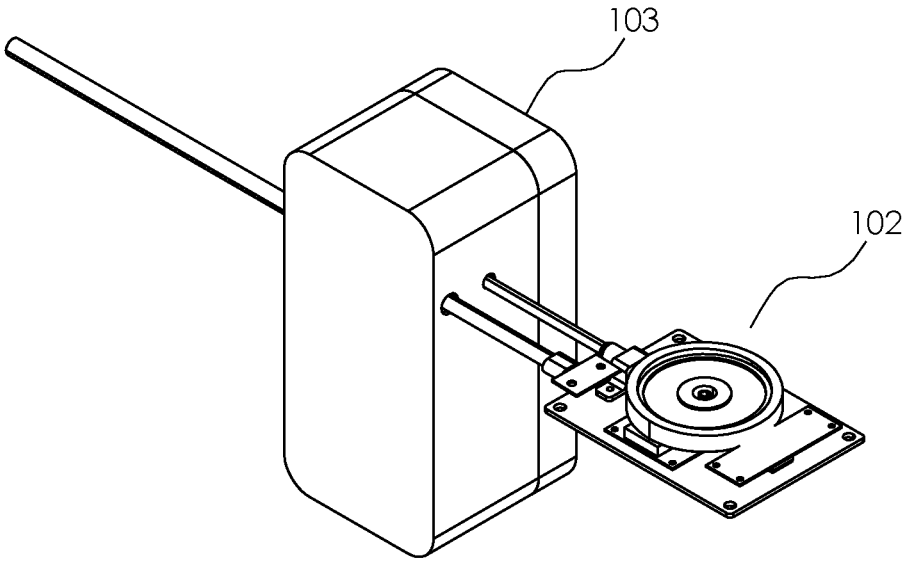
FIG. 5 is a perspective view of an embodiment of the disclosure.
Figure 6:
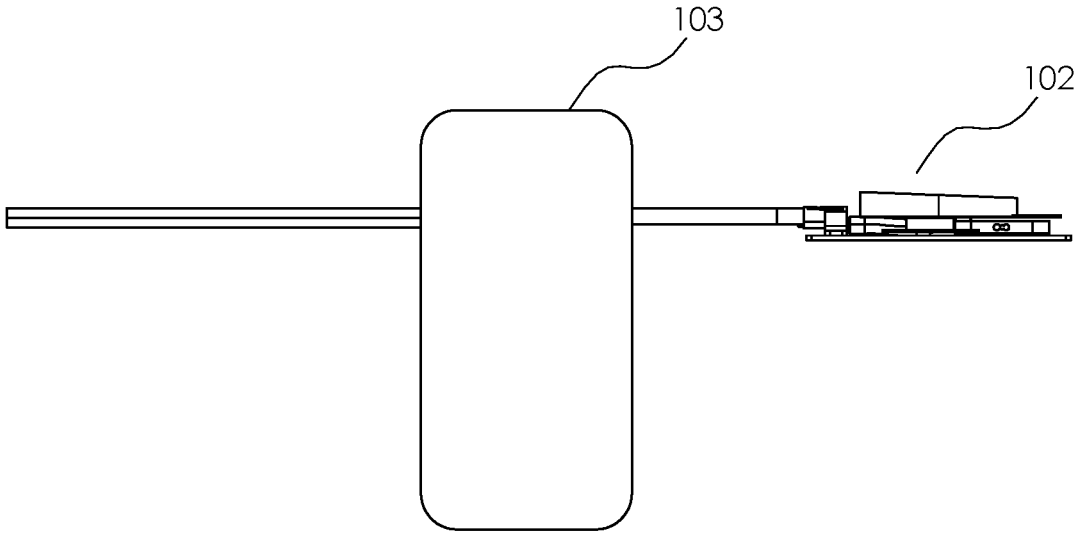
FIG. 6 is a front view of an embodiment of the disclosure.
Figure 7:
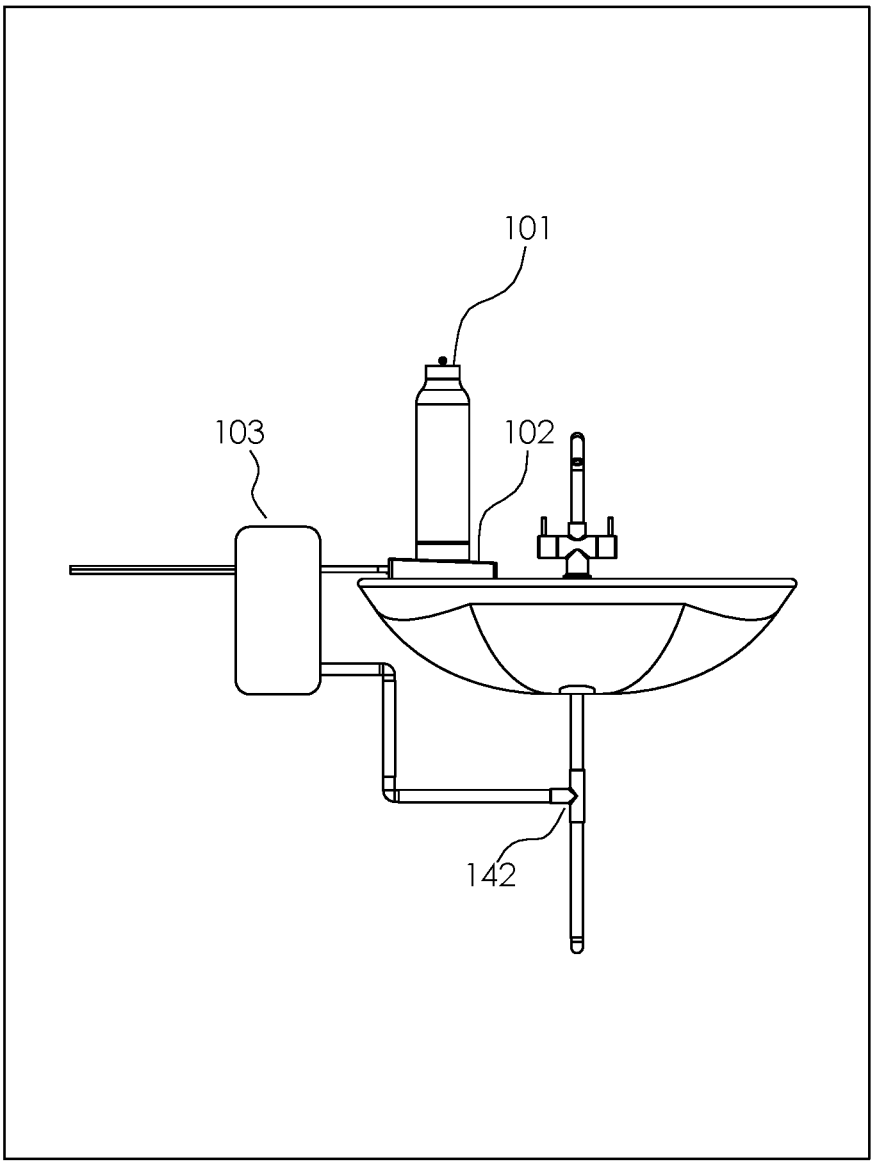
FIG. 7 is an in-use view of an embodiment of the disclosure.
Figure 8:
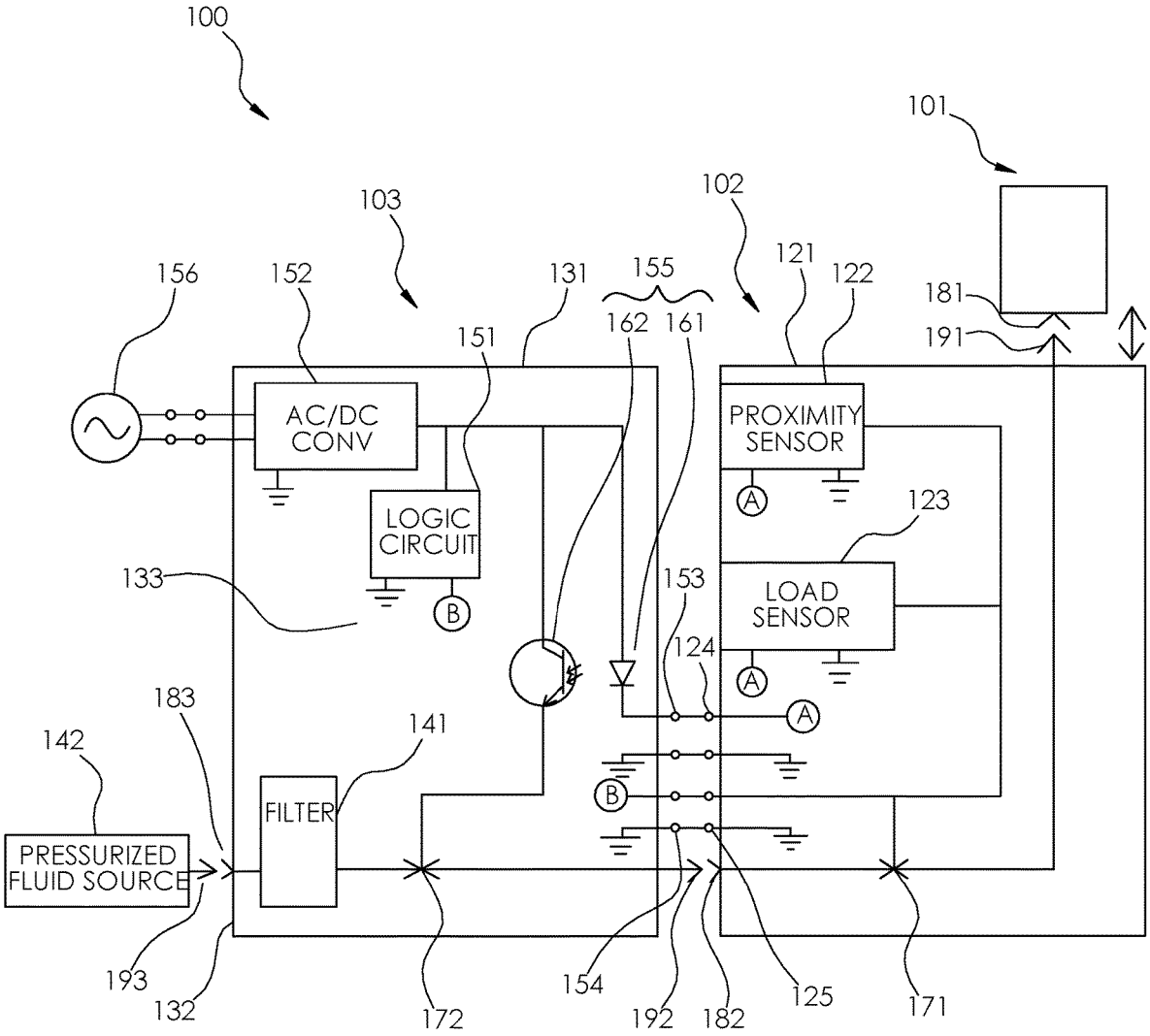
FIG. 8 is a schematic view of an embodiment of the disclosure.

Detailed reference will now be made to one or more potential embodiments of the disclosure, which are illustrated in FIGS. 1 through 8.

The bottle filling system 100 (hereinafter invention) comprises a bottle 101, a fill base structure 102, and a control structure 103. The bottle 101, the fill base structure 102, and the control structure 103 are fluidically interconnected. The fill base structure 102 and the control structure 103 are electrically interconnected. The control structure 103 controls the flow of a fluid from a pressurized fluid source 142 into the fill base structure 102. The fill base structure 102 transports the fluid received from the control structure 103 to the bottle 101. The control structure 103 detects the presence of the bottle 101 relative to the fill base structure 102. The control structure 103 measures the amount of fluid in the bottle 101. The control structure 103 automatically replenishes the amount of fluid contained in the bottle 101.

The bottle 101 is a container. The bottle 101 contains a fluid that is drawn from a pressurized fluid source 142. The bottle 101 forms a fluidic connection with the fill base structure 102. The fill base structure 102 discharges the fluid into the bottle 101. The control structure 103 detects when the bottle 101 is in proximity to the fill base structure 102. The control structure 103 measures the amount of fluid in the bottle 101. The control structure 103 controls the flow of fluid into the bottle 101. The control structure 103 controls the amount of fluid into the bottle 101. The bottle 101 further comprises a first intake fitting 181. The first intake fitting 181 is the fitting that receives fluid from the fill base structure 102 and transports the received fluid to the containment structure of the bottle 101.

The fill base structure 102 is an electromechanical structure. The fill base structure 102 fluidically connects to the bottle 101. The fill base structure 102 fluidically connects to the control structure 103. The fill base structure 102 electrically connects to the control structure 103. The fill base structure 102 receives the fluid from the control structure 103 and transports the received fluid to the bottle 101. The fill base structure 102 measures the amount of fluid in the bottle 101 and transmits this information to the control structure 103. The fill base structure 102 detects when the bottle 101 is proximal to the fill base structure 102 and transmits this information to the control structure 103.

The fill base structure 102 comprises a pedestal structure 121, a proximity sensor 122, a load sensor 123, a power port 124, a bus port 125, a first solenoid valve 171, a second intake fitting 182, and a first discharge fitting 191. The pedestal structure 121 contains the proximity sensor 122, the load sensor 123, the power port 124, the bus port 125, the first solenoid valve 171, the second intake fitting 182, and the first discharge fitting 191. The second intake fitting 182, the first solenoid valve 171, and the first discharge fitting 191 are fluidically interconnected. The proximity sensor 122, the load sensor 123, the power port 124, the bus port 125, and the first solenoid valve 171 are electrically interconnected.

The pedestal structure 121 is a rigid structure. The pedestal structure 121 contains the balance of the fill base structure 102. The pedestal structure 121 is formed with all apertures and form factors necessary to allow the pedestal structure 121 to accommodate the use and operation of the fill base structure 102. Methods to form a pedestal structure 121 suitable for the purposes described in this disclosure are well-known and documented in the mechanical arts.

The proximity sensor 122 is an electric sensing device. The proximity sensor 122 detects when the bottle 101 is fluidically connected to the fill base structure 102. The proximity sensor 122 electrically connects to the control structure 103. The proximity sensor 122 transmits the detection of the fluidic connection between the bottle 101 and the fill base structure 102 to the control structure 103.

The load sensor 123 is an electric sensing device. The load sensor 123 measures the amount of fluid in the bottle 101. The load sensor 123 electrically connects to the control structure 103. The load sensor 123 transmits the measured amount of fluid in the bottle 101.

The power port 124 is an electric port. The power port 124 electrically connects to the control structure 103. The power port 124 receives electric power from the control structure 103. The power port 124 distributes the received electric power to the proximity sensor 122, the load sensor 123, and the first solenoid valve 171.

The bus port 125 is an electric port. The bus port 125 electrically connects to the control structure 103. The bus port 125 exchanges control signals between the fill base structure 102 and the control structure 103. The bus port 125 transmits electric signals from encoding the fluidic connection status between the bottle 101 and the fill base structure 102 to the control structure 103 through the bus port 125. The bus port 125 transmits electric signals from encoding the amount of fluid in the bottle 101 to the control structure 103 through the bus port 125. The bus port 125 receives control signals from the control structure 103 from the bus port 125 and transmits the received control signals to the first solenoid valve 171. The control structure 103 controls the operation of the first solenoid valve 171 through the bus port 125.

The first solenoid valve 171 is an electrically controlled valve. The control structure 103 controls the operation of the first solenoid valve 171. The first solenoid valve 171 controls the flow of the fluid from the second intake fitting 182 of the fill base structure 102 to the first discharge fitting 191 of the fill base structure 102.

The second intake fitting 182 is the fitting that receives fluid from the control structure 103 and transports the received fluid to the first solenoid valve 171 of the fill base structure 102. The first discharge fitting 191 is the fitting that inserts into the first intake fitting 181 to form the fluidic connection between the fill base structure 102 and the bottle 101.

The control structure 103 is an electromechanical structure. The control structure 103 forms a fluidic connection with the fill base structure 102. The control structure 103 forms an electrical connection with the fill base structure 102. The control structure 103 draws a fluid under pressure from a pressurized fluid source 142. The control structure 103 filters the fluid drawn from the pressurized fluid source 142. The control structure 103 transports the fluid from the pressurized fluid source 142 into the fill base structure 102. The control structure 103 controls the amount of fluid flowing into the fill base structure 102. The control structure 103 controls the flow of fluid through the fill base structure 102. The control structure 103 controls the amount of fluid that flows into the bottle 101. The control structure 103 comprises a housing 131, a fluid network 132, and a control circuit 133. The housing 131 contains the fluid network 132 and the control circuit 133.

The housing 131 is a rigid structure. The housing 131 contains the fluid network 132 and the control circuit 133. The housing 131 is formed with all apertures and form factors necessary to allow the housing 131 to accommodate the use and operation of the fluid network 132 and the control circuit 133. Methods to form a housing 131 suitable for the purposes described in this disclosure are well-known and documented in the mechanical arts.

The fluid network 132 forms the fluidic connection between the pressurized fluid source 142 and the fill base structure 102. The fluid network 132 physically controls the fluid flowing through the fluid network 132. The fluid network 132 filters the fluid as it flows through the fluid network 132. The fluid network 132 comprises a filter bed 141, a pressurized fluid source 142, a second solenoid valve 172, a third intake fitting 183, and a second discharge fitting 192. The filter bed 141, the pressurized fluid source 142, the second solenoid valve 172, the third intake fitting 183, and the second discharge fitting 192 are fluidically interconnected. The pressurized fluid source 142 further comprises a third discharge fitting 193.

The filter bed 141 is a filter. The filter bed 141 inserts into the fluid flow path of the fluid network 132 such that the filter bed 141 filters all the fluid that flows through the control structure 103. The filter bed 141 is defined elsewhere in this disclosure. The pressurized fluid source 142 is an externally provided source of the fluid that is contained within the bottle 101. In the first potential embodiment of the disclosure, the applicant anticipates that the pressurized fluid source 142 is drawn from the supply side of a domestic plumbing system.

The second solenoid valve 172 is an electrically controlled valve. The second solenoid valve 172 interlock circuit 155 controls the operation of the second solenoid valve 172. The second solenoid valve 172 controls the flow of the fluid from the filter bed 141 of the control structure 103 to the second discharge fitting 192 of the control structure 103.

The control circuit 133 is an electric circuit. The control circuit 133 provides the electric energy required to operate the fill base structure 102. The control circuit 133 provides the electric energy required to operate the fluid network 132. The control circuit 133 controls the amount of fluid flowing into the fill base structure 102. The control circuit 133 controls the flow of fluid through the fill base structure 102. The control circuit 133 controls the amount of fluid that flows into the bottle 101. The control circuit 133 controls the flow of fluid through the fluid network 132. The control circuit 133 comprises a logic circuit 151, an ac/dc converter 152, a power plug 153, a bus plug 154, and a second solenoid valve 172 interlock circuit 155. The logic circuit 151, the ac/dc converter 152, the power plug 153, the bus plug 154, and the second solenoid valve 172 interlock circuit 155 are electrically interconnected.

The logic circuit 151 is an electric circuit. The logic circuit 151 receives an electric signal from the proximity sensor 122 of the fill base structure 102. The logic circuit 151 receives an electric signal from the load sensor 123 of the fill base structure 102. The logic circuit 151 generates a control signal to the first solenoid valve 171 when the logic circuit 151 determines that: a) the bottle 101 is fluidically connected to the fill base structure 102; and, b) the amount of fluid contained in the bottle 101 is less than a previously determined value. The logic circuit 151 discontinues the control signal to the first solenoid valve 171 when the logic circuit 151 determines that either: a) the bottle 101 is not fluidically connected to the fill base structure 102; or b) the amount of fluid contained in the bottle 101 is greater than the previously determined value.

The ac/dc converter 152 generates the dc electric energy required to operate both the fill base structure 102 and the control structure 103. The ac/dc converter 152 converts ac electric energy drawn from the external power source 156 into dc electric energy. The ac/dc converter 152 transmits the generated electric energy to the fill base structure 102 (through the power plug 153), the logic circuit 151, and the second solenoid valve 172 (through the second solenoid valve 172 interlock circuit 155). The ac/dc converter 152 is defined elsewhere in this disclosure. The ac/dc converter 152 further comprises an external power source 156. The ac/dc converter 152 electrically connects to the external power source 156.

The power plug 153 is an electric plug. The power plug 153 forms an electrical connection between the ac/dc converter 152 and the fill base structure 102 by plugging into the power port 124 of the fill base structure 102. The power plug 153 transmits electric energy from the ac/dc converter 152 into the power port 124. The bus plug 154 is an electric plug. The bus plug 154 forms an electrical connection between the logic circuit 151 and the fill base structure 102 by plugging into the bus port 125 of the fill base structure 102. The bus plug 154 forms the electric connections required to transfer the control signals from the proximity sensor 122 and the load sensor 123 to the logic circuit 151. The bus plug 154 forms the electric connections required to transfer the control signals from the logic circuit 151 to the first solenoid valve 171.

The second solenoid valve 172 interlock circuit 155 is an electric circuit. The second solenoid valve 172 interlock circuit 155 enables the flow of fluid through the second solenoid valve 172 when the fill base structure 102 is drawing electric energy from the ac/dc converter 152. The second solenoid valve 172 interlock circuit 155 disables the flow of fluid through the second solenoid valve 172 when the fill base structure 102 is electrically disconnected from the ac/dc converter 152. The external power source 156 is an externally provided source of ac electric energy. The applicant assumes that the external power source 156 is the national electric grid. The phototransistor 162 is a light actuated transistor. The phototransistor 162 forms a switch that controls the flow of dc electric energy from the ac/dc converter 152 into the second solenoid valve 172.

The LED 161 is a diode. The LED 161 generates the light necessary to optically link with the phototransistor 162. The LED 161 controls the operation of the phototransistor 162. The LED 161 electrically connects between the ac/dc converter 152 and the power plug 153 such that the flow of electric energy through the power plug 153 into the fill base structure 102 illuminates the LED 161. The second solenoid valve 172 interlock circuit 155 further comprises a LED 161 and a phototransistor 162. The LED 161 and the phototransistor 162 are optically linked.

The phototransistor 162 operates as a switch. When the light of the LED 161 illuminates the phototransistor 162, the phototransistor 162 will act like a closed switch allowing current flow from the ac/dc converter 152 to the second solenoid valve 172. The flow of current into the second solenoid valve 172 actuates the second solenoid valve 172 to the open position. When LED 161 discontinues the illumination of the phototransistor 162, the phototransistor 162 will act like an open switch prohibiting current flow from the ac/dc converter 152 to the second solenoid valve 172. The discontinuation of the flow of current into the second solenoid valve 172 actuates the second solenoid valve 172 to the closed position.

The second discharge fitting 192 is the fitting that inserts into the second intake fitting 182 to form the fluidic connection between the control structure 103 and the fill base structure 102. The third intake fitting 183 is the fitting that receives fluid from the pressurized fluid source 142 and transports the received fluid to the filter bed 141 to the control structure 103. The third discharge fitting 193 is the fitting that inserts into the third intake fitting 183 to form the fluidic connection between the pressurized fluid source 142 and the filter bed 141 of the control structure 103.

The following definitions were used in this disclosure:

AC: As used in this disclosure, AC is an acronym for alternating current.

AC/DC Converter: As used in this disclosure, an AC/DC converter is an electrical device that converts an AC voltage into a regulated DC voltage by rectifying and regulating the AC voltage. Method to design and build AC/DC converters are well known in the electrical arts. The AC/DC converter is further defined with a positive terminal, a negative terminal and a power input.

Bed Filter: As used in this disclosure, a bed filter comprises a particulate material through which a fluid is passed such that particulate material captures solids contained within the fluid while allowing the fluid itself to pass through the particulate matter.

Bottle: As used in this disclosure, a bottle is a container used for the storage of fluids. A bottle generally comprises a flask and a neck. The flask is a pan shaped containment structure. The neck is a tubular structure that provides access to the interior of the flask. The neck comprises: a) a tube structure that forms an aperture through which fluids can be introduced and removed from the bottle; and, b) a physical structure that encloses the open face of the pan structure of the flask such that the inner diameter of the neck need not be identical to the inner diameter of the flask.

Bus: As used in this disclosure, a bus is a physical arrangement of one or more electrical conductors that are used to facilitate the transfer of electrical signals between components of a logic circuit.

Communication Link: As used in this disclosure, a communication link refers to the structured exchange of data between two objects.

Control Circuit: As used in this disclosure, a control circuit is an electrical circuit that manages and regulates the behavior or operation of a device.

DC: As used in this disclosure, DC is an acronym for direct current.

Diode: As used in this disclosure, a diode is a two terminal semiconductor device that allows current flow in only one direction. The two terminals are called the anode and the cathode. Electric current is allowed to pass from the anode to the cathode.

Domestic Plumbing System: As used in this disclosure, a domestic plumbing system refers to a fluidic network that is formed within a building. The domestic plumbing system transports water received from a utility through the building. Specifically, the domestic plumbing system: a) receives fresh water from the utility and distributes the fresh water through the building; and, b) transports gray water generated within the building and returns the gray water back to the utility for disposal. The domestic plumbing system comprises a supply side and a DWV.

DWV: As used in this disclosure, DWV is an acronym for drainage, waste, and vent. With a domestic plumbing system, DWV refers to the plumbing subnetwork that transports waste water out of the residence to an appropriate waste water handling system.

External Power Source: As used in this disclosure, an external power source is a source of the energy that is externally provided to enable the operation of the present disclosure. Examples of external power sources include, but are not limited to, electrical power sources and compressed air sources.

Filter: As used in this disclosure, a filter is a mechanical device that is used to separate solids that are suspended in a liquid or a gas. A strainer is type of filter with what would be considered a coarse mesh measurement.

Fitting: As used in this disclosure, a fitting is a component that attaches a first object to one or more additional objects. The fitting is often used to forming a fluidic connection between the first object and the one or more additional objects.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Housing: As used in this disclosure, a housing is a rigid structure that encloses and protects one or more devices.

LED: As used in this disclosure, an LED is an acronym for a light emitting diode. A light emitting diode is a diode that is also a light source.

Liquid: As used in this disclosure, a liquid refers to a state (phase) of matter that is fluid and that maintains, for a given pressure, a fixed volume that is independent of the volume of the container.

Logic Circuit: As used in this disclosure, a logic circuit is electrical device that receives one or more digital or analog inputs and uses those digital or analog inputs to generate one or more digital or analog outputs. This disclosure allows, but does not assume, that the logic circuit is programmable.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid comprises one or more utilities that sell electrical power for use by an electrical load. The national electric grid invoices for electrical power based on the total energy consumed by the electrical load. The national electric grid measures the energy consumption of an electrical load with an electrical meter. The national electric grid provides power through electrical connections known as a hot lead and a neutral lead.

Normally Closed: As used in this disclosure, normally closed refers to an externally controlled electrical switching device, such as a relay or a momentary switch, which passes electric current when the externally controlled electrical switching device is in an unpowered state. In a common alternate usage, the term normally closed valve is taken to mean that the normally closed valve prevents the flow of fluid through the normally closed valve when the normally closed valve is in an unpowered state.

Normally Open: As used in this disclosure, normally open refers to an externally controlled electrical switching device, such as a relay or a momentary switch, which does not pass electric current when the externally controlled electrical switching device is in an unpowered state. In a common alternate usage, the term normally open valve is taken to mean that the normally open valve allows the flow of fluid through the normally open valve when the normally open valve is in an unpowered state.

Pedestal: As used in this disclosure, a pedestal is an intermediary load bearing structure that forms a load path between a supporting surface and an object, structure, or load.

Phase: As used in this disclosure, phase refers to the state of the form of matter. The common states of matter are solid, liquid, gas, and plasma.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Phototransistor: As used in this disclosure, a phototransistor is a two terminal photoelectric device that performs in the manner of a transistor within an electrical circuit. Specifically, when exposed to light a phototransistor will behave as a transistor with a voltage applied to the base that creates a base current flow into the transistor.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port. A solenoid valve comprises a coil and a valve. The coil forms the solenoid that opens and closes the solenoid valve. The solenoid valve is a valve that opens and closes to control the fluid flow.

Solid: As used in this disclosure, a solid refers to a state (phase) of matter that: 1) has a fixed volume; and, 2) does not flow.

Supply Side: As used in this disclosure, the supply side refers to the plumbing subnetwork within a domestic plumbing system that provisions fresh water for use within the residence.

Transistor: As used in this disclosure, a transistor is a general term for a three terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

Valve: As used in this disclosure, a valve is a device that is used to control the flow of a fluid (gas or liquid) through a pipe, tube, or hose.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bottle filling system comprising a bottle, a fill base structure, and a control structure;

wherein the bottle, the fill base structure, and the control structure are fluidically interconnected;

wherein the fill base structure and the control structure are electrically interconnected;

wherein the fill base structure comprises a pedestal structure, a proximity sensor, a load sensor, a power port, a bus port, a first solenoid valve, a second intake fitting, and a first discharge fitting;

wherein the pedestal structure contains the proximity sensor, the load sensor, the power port, the bus port, the first solenoid valve, the second intake fitting, and the first discharge fitting;

wherein the second intake fitting, the first solenoid valve, and the first discharge fitting are fluidically interconnected;

wherein the proximity sensor, the load sensor, the power port, the bus port, and the first solenoid valve are electrically interconnected.

2. The bottle filling system according to claim 1 wherein the control structure controls the flow of a fluid from a pressurized fluid source into the fill base structure;

wherein the fill base structure transports the fluid received from the control structure to the bottle;

wherein the control structure detects the presence of the bottle relative to the fill base structure;

wherein the control structure measures the amount of fluid in the bottle;

wherein the control structure automatically replenishes the amount of fluid contained in the bottle.

3. The bottle filling system according to claim 2 wherein the bottle is a container;

wherein the bottle contains the fluid that is drawn from the pressurized fluid source;

wherein the bottle forms a fluidic connection with the fill base structure;

wherein the fill base structure discharges the fluid into the bottle;

wherein the control structure detects when the bottle is in proximity to the fill base structure;

wherein the control structure measures the amount of fluid in the bottle;

wherein the control structure controls the flow of fluid into the bottle;

wherein the control structure controls the amount of fluid in the bottle.

4. The bottle filling system according to claim 3 wherein the fill base structure is an electromechanical structure;

wherein the fill base structure fluidically connects to the bottle;

wherein the fill base structure fluidically connects to the control structure;

wherein the fill base structure electrically connects to the control structure;

wherein the fill base structure receives the fluid from the control structure and transports the received fluid to the bottle;

wherein the fill base structure measures the amount of fluid in the bottle and transmits this information to the control structure;

wherein the fill base structure detects when the bottle is proximal to the fill base structure and transmits this information to the control structure.

5. The bottle filling system according to claim 4 wherein the control structure is an electromechanical structure;

wherein the control structure forms a fluidic connection with the fill base structure;

wherein the control structure forms an electrical connection with the fill base structure;

wherein the control structure draws a fluid under pressure from the pressurized fluid source;

wherein the control structure filters the fluid drawn from the pressurized fluid source;

wherein the control structure transports the fluid from the pressurized fluid source into the fill base structure;

wherein the control structure controls the amount of fluid flowing into the fill base structure;

wherein the control structure controls the flow of fluid through the fill base structure;

wherein the control structure controls the amount of fluid that flows into the bottle.

6. The bottle filling system according to claim 5 wherein the bottle further comprises a first intake fitting;

wherein the first intake fitting is the fitting that receives fluid from the fill base structure and transports the received fluid to the containment structure of the bottle.

7. The bottle filling system according to claim 6 wherein the control structure comprises a housing, a fluid network, and a control circuit;

wherein the housing contains the fluid network and the control circuit;

wherein the housing is a rigid structure;

wherein the housing contains the fluid network and the control circuit;

wherein the fluid network forms the fluidic connection between the pressurized fluid source and the fill base structure;

wherein the fluid network physically controls the fluid flowing through the fluid network;

wherein the fluid network filters the fluid as it flows through the fluid network;

wherein the control circuit is an electric circuit;

wherein the control circuit provides the electric energy required to operate the fill base structure;

wherein the control circuit provides the electric energy required to operate the fluid network;

wherein the control circuit controls the amount of fluid flowing into the fill base structure;

wherein the control circuit controls the flow of fluid through the fill base structure;

wherein the control circuit controls the amount of fluid that flows into the bottle;

wherein the control circuit controls the flow of fluid through the fluid network.

8. The bottle filling system according to claim 7 wherein the fluid network comprises a filter bed, a pressurized fluid source, a second solenoid valve, a third intake fitting, and a second discharge fitting;

wherein the filter bed, the pressurized fluid source, the second solenoid valve, the third intake fitting, and the second discharge fitting are fluidically interconnected;

wherein the pressurized fluid source further comprises a third discharge fitting.

9. The bottle filling system according to claim 8 wherein the control circuit comprises a logic circuit, an ac/dc converter, a power plug, a bus plug, and a second solenoid valve interlock circuit;

wherein the logic circuit, the ac/dc converter, the power plug, the bus plug, and the second solenoid valve interlock circuit are electrically interconnected.

10. The bottle filling system according to claim 9 wherein the proximity sensor is an electric sensing device;

wherein the proximity sensor detects when the bottle is fluidically connected to the fill base structure;

wherein the proximity sensor electrically connects to the control structure;

wherein the proximity sensor transmits the detection of the fluidic connection between the bottle and the fill base structure to the control structure.

11. The bottle filling system according to claim 10 wherein the load sensor is an electric sensing device;

wherein the load sensor measures the amount of fluid in the bottle;

wherein the load sensor electrically connects to the control structure;

wherein the load sensor transmits the measured amount of fluid in the bottle.

12. The bottle filling system according to claim 11 wherein the power port is an electric port;

wherein the power port electrically connects to the control structure;

wherein the power port receives electric power from the control structure;

wherein the power port distributes the received electric power to the proximity sensor, the load sensor, and the first solenoid valve;

wherein the bus port is an electric port;

wherein the bus port electrically connects to the control structure;

wherein the bus port exchanges control signals between the fill base structure and the control structure;

wherein the bus port transmits electric signals from encoding the fluidic connection status between the bottle and the fill base structure to the control structure through the bus port;

wherein the bus port transmits electric signals from encoding the amount of fluid in the bottle to the control structure through the bus port;

wherein the bus port receives control signals from the control structure from the bus port and transmits the received control signals to the first solenoid valve;

wherein the control structure controls the operation of the first solenoid valve through the bus port.

13. The bottle filling system according to claim 12 wherein the first solenoid valve is an electrically controlled valve;

wherein the first solenoid valve controls the flow of the fluid from the second intake fitting of the fill base structure to the first discharge fitting of the fill base structure;

wherein the second intake fitting is the fitting that receives fluid from the control structure and transports the received fluid to the first solenoid valve of the fill base structure;

wherein the first discharge fitting is the fitting that inserts into the first intake fitting to form the fluidic connection between the fill base structure and the bottle.

14. The bottle filling system according to claim 13 wherein the filter bed is a filter;

wherein the filter bed inserts into the fluid flow path of the fluid network such that the filter bed filters all the fluid that flows through the control structure;

wherein the filter bed is defined elsewhere in this disclosure;

wherein the pressurized fluid source is an externally provided source of the fluid that is contained within the bottle;

wherein the second solenoid valve is an electrically controlled valve;

wherein the second solenoid valve interlock circuit controls the operation of the second solenoid valve;

wherein the second solenoid valve controls the flow of the fluid from the filter bed of the control structure to the second discharge fitting of the control structure.

15. The bottle filling system according to claim 14 wherein the logic circuit is an electric circuit;

wherein the logic circuit receives an electric signal from the proximity sensor of the fill base structure;

wherein the logic circuit receives an electric signal from the load sensor of the fill base structure;

wherein the logic circuit generates a control signal to the first solenoid valve when the logic circuit determines that: a) the bottle is fluidically connected to the fill base structure; and, b) the amount of fluid contained in the bottle is less than a previously determined value;

wherein the logic circuit discontinues the control signal to the first solenoid valve when the logic circuit determines that either: a) the bottle is not fluidically connected to the fill base structure; or b) the amount of fluid contained in the bottle is greater than the previously determined value;

wherein the ac/dc converter generates the dc electric energy required to operate both the fill base structure and the control structure;

wherein the ac/dc converter converts ac electric energy drawn from the external power source into dc electric energy;

wherein the ac/dc converter transmits the generated electric energy to the fill base structure (through the power plug), the logic circuit, and the second solenoid valve (through the second solenoid valve interlock circuit);

wherein the ac/dc converter further comprises an external power source;

wherein the ac/dc converter electrically connects to the external power source;

wherein the power plug is an electric plug;

wherein the power plug forms an electrical connection between the ac/dc converter and the fill base structure by plugging into the power port of the fill base structure;

wherein the power plug transmits electric energy from the ac/dc converter into the power port;

wherein the bus plug is an electric plug;

wherein the bus plug forms an electrical connection between the logic circuit and the fill base structure by plugging into the bus port of the fill base structure;

wherein the bus plug forms the electric connections required to transfer the control signals from the proximity sensor and the load sensor to the logic circuit;

wherein the bus plug forms the electric connections required to transfer the control signals from the logic circuit to the first solenoid valve;

wherein the second solenoid valve interlock circuit is an electric circuit;

wherein the second solenoid valve interlock circuit enables the flow of fluid through the second solenoid valve when the fill base structure is drawing electric energy from the ac/dc converter;

wherein the second solenoid valve interlock circuit disables the flow of fluid through the second solenoid valve when the fill base structure is electrically disconnected from the ac/dc converter;

wherein the second discharge fitting is the fitting that inserts into the second intake fitting to form the fluidic connection between the control structure and the fill base structure;

wherein the third intake fitting is the fitting that receives fluid from the pressurized fluid source and transports the received fluid to the filter bed to the control structure;

wherein the third discharge fitting is the fitting that inserts into the third intake fitting to form the fluidic connection between the pressurized fluid source and the filter bed of the control structure.

* * * * *